United States Patent [19]

Lin et al.

[11] Patent Number: 4,497,449

[45] Date of Patent: Feb. 5, 1985

[54] METHOD OF AND ARRANGEMENT FOR ASSEMBLING ELECTRICAL COILS AROUND TRANSFORMER CORES

[75] Inventors: Kou C. Lin, Hermitage; Charles E. Burkhardt, Sharon, both of Pa.

[73] Assignee: Electric Power Research Institute, Inc., Palo Alto, Calif.

[21] Appl. No.: 387,335

[22] Filed: Jun. 11, 1982

[51] Int. Cl.[3] ..... H01F 41/08

[52] U.S. Cl. ..... 242/4 R; 29/605; 140/92.2; 156/446

[58] Field of Search ..... 242/4 R, 4 A, 6, 7.03; 29/605; 72/142, 148; 140/92.2; 156/172, 173, 175, 185, 191, 425, 446, 457

[56] References Cited

U.S. PATENT DOCUMENTS

| | | | |
|---|---|---|---|
| 2,219,182 | 10/1940 | Granfield | 242/4 R X |
| 2,221,687 | 11/1940 | Evans | 242/4 R |
| 2,246,239 | 6/1941 | Brand | 242/4 R X |
| 2,305,999 | 12/1942 | Steinmayer et al. | 242/4 R |
| 2,366,977 | 1/1945 | Morrison | 242/4 R |
| 2,441,439 | 5/1948 | Nelson | 242/4 R |
| 2,758,796 | 8/1956 | Zwelling | 242/4 A |
| 2,968,445 | 1/1961 | Everhart et al. | 29/605 |

*Primary Examiner*—Stuart S. Levy
*Assistant Examiner*—David Werner
*Attorney, Agent, or Firm*—Flehr, Hohbach, Test, Albritton & Herbert

[57] ABSTRACT

An electrical inductive apparatus such as a transformer including a magnetic core and an associated electrical coil is disclosed herein along with various methods of assembling the coil around the core. In each of the various embodiments disclosed, the core itself is one which is initially formed from a continuous strip or strips of amorphous material formed to provide a closed loop which is thereafter annealed but before its coil is assembled thereto. Various techniques are disclosed for winding the coil around a corresponding section of the core.

4 Claims, 13 Drawing Figures

METHOD OF AND ARRANGEMENT FOR ASSEMBLING ELECTRICAL COILS AROUND TRANSFORMER CORES

The present invention relates generally to an electrical inductive apparatus such as a transformer (hereinafter referred to collectively as such) which includes a magnetic core and an associated electrical coil and more particularly to a method of and an arrangement for assembling the coil around one section of its associated core, especially a closed loop shaped core formed from annealed amorphous metal material such as METGLAS amorphous strip material manufactured by Allied Chemical Corporation.

One common way to make a magnetic core for use in electrical inductive apparatus such as a transformer is to use magnetic strip material having a preferred direction of orientation parallel to the longitudinal dimension of the material, e.g., non-amorphous material. This material is relatively flexible and easy to form into the ultimate shape of the core both before and after it is stress relief annealed. As a result of this continued flexibility, an associated electrical coil (or coils) can be readily assembled around the core after annealing the latter by merely providing the core with a joint which is flexed open to receive the coil. However, this assembly procedure is not satisfactory if the core is made from amorphous metal strip material such as the METGLAS material referred to above. Specifically, although this latter material once annealed has lower core loss characteristics than annealed non-amorphous material, the stress relief annealing of the amorphous material results in a reduction in its ductility and flexibility, thereby leaving it relatively brittle. This, in turn, makes it more difficult to flex open its joint for assembling an associated coil without chipping or otherwise breaking the core laminations at the joint, without creating undesirable external stresses in the individual laminations, and/or without otherwise damaging the core.

One solution to the problem just discussed is to assemble each coil around its associated amorphous metal core before the latter is annealed and becomes too brittle. Another solution is to wind each coil by hand around its associated core after the latter has been formed into a closed loop and annealed. Obviously, this latter approach is time consuming and therefore quite expensive to carry out in any large quantities. However, as will be seen hereinafter, the present invention is directed to this latter approach of assembling each coil to its associated core after the latter has been formed and annealed but in ways which are substantially less time consuming than by hand.

In view of the foregoing, one object of the present invention is to provide various automated techniques for assembling an electrical coil around one section of an associated transformer core, especially an already annealed amorphous metal core in the form of a closed loop.

Another object of the present invention is to provide the various techniques just recited in uncomplicated, reliable and yet economical ways.

As will be discussed in more detail hereinafter, the overall transformer or other such electrical inductive apparatus disclosed herein is one which includes a magnetic core and at least one electrical coil disposed around one section of the core. In a preferred embodiment, the magnetic core is formed from amorphous metal material such as the previously recited METGLAS material which is formed into a closed loop shape and annealed before the coil is assembled thereto. In accordance with a preferred embodiment of the present invention, the coil is supported to its associated core section by first placing a coil supporting straight tubular member around that particular core section in a way which allows the tubular member to rotate about its own axis. At the same time, a supply of coil material is provided such that the material is ready to be wound around the tubular member. In this way, one end section of the coil material can be connected to or otherwise brought into engagement with the tubular member and the latter can be rotated by means of a power driven mechanism so as to automatically cause the coil material to wind around the tubular member and therefore around its associated core section, thereby providing the ultimately assembled coil in a rapid and reliable but economical fashion. Various specific techniques for carrying out this automated winding process and other ways of automatically assembling a coil to its associated core will be described in more detail hereinafter in conjunction with the drawings wherein:

FIG. 1 is a side elevational view of a closed loop shaped magnetic core around which at least one electrical coil is to be assembled in accordance with various embodiments of the present invention;

FIGS. *2a–2e* are cross-sectional views illustrating different embodiments of the magnetic core shown in FIG. 1, taken generally along line 2—2 in FIG. 1;

Figure 1:
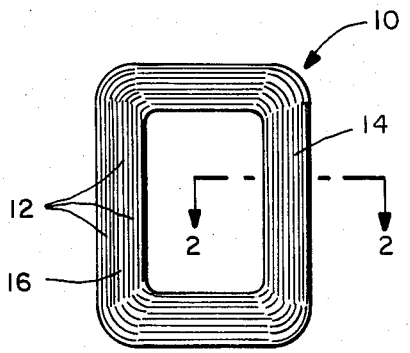
Figure 8:
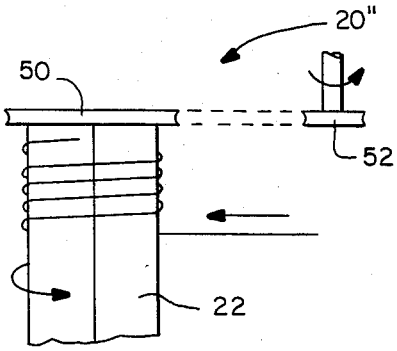
Figure 9:
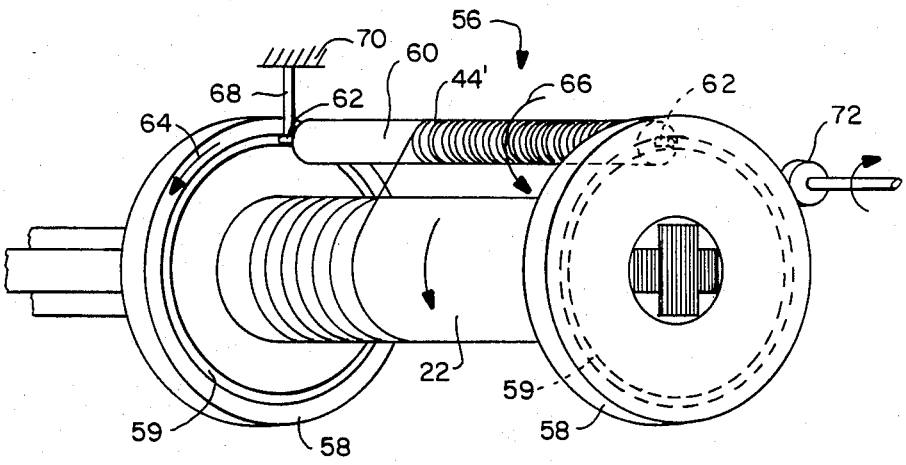

FIG. 8 is a side elevational view of a portion of an arrangement designed in accordance with a third embodiment of the present invention for automatically assembling an electrical coil around an associated leg of the core illustrated in FIG. 1; and FIG. 9 is a perspective view of an arrangement designed in accordance with a fourth embodiment of the present invention for winding an electrical coil around an associated leg of the core illustrated in FIG. 1.

Turning now to the drawings, wherein like components are designated by like reference numerals throughout the various figures, attention is first directed to FIG. 1 which illustrates a magnetic core 10 for use as part of the transformer or like electrical inductive apparatus (not shown). In the specific embodiment illustrated, transformer 10 is formed from a continuous length of amorphous strip material such as the previously recited METGLAS material and takes the shape of a closed loop having a plurality of turns or laminates 12. The shape of the closed loop shown is that of a rectangle including opposite leg sections 14 and 16.

Figure 2A:
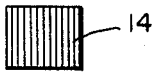
Figure 2B:
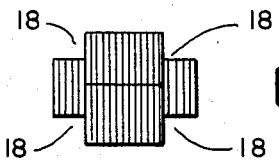
Figure 2C:
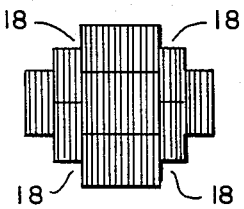
Figure 2D:
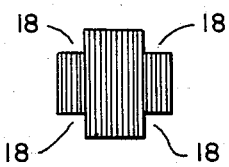
Figure 2E:
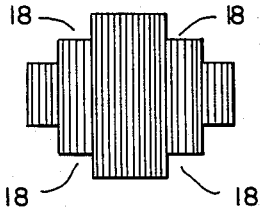

The cross-section of core 10 using a single continuous strip of material to form the core is illustrated in FIG. 2*a*. FIGS. 2*b*, 2*c*, 2*d* and 2*e* illustrate different cross-sections of the core when more than one strip is utilized. In each of these latter cross-sectional configurations, four diametrically opposite inside corners 18 are formed around the core and are utilized for reasons to be discussed hereinafter. As will also be seen hereinafter, the present invention does not require that core 10 be formed from a continuous strip or strips of material but could be formed from laminated plates or even a solid integrally formed unit, at least as far as the present invention is concerned.

Figure 3:
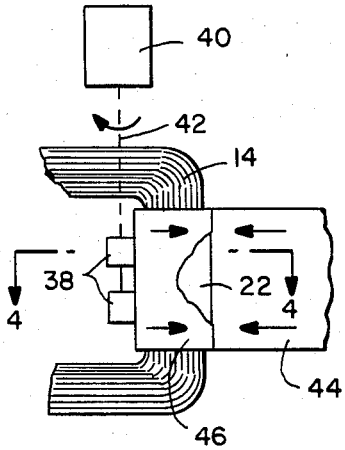
FIG. 3 is a side elevational view of part of an arrangement designed in accordance with one embodiment of the present invention for automatically assembling an electrical coil around one leg of the core illustrated in FIG. 1.
Figure 4:
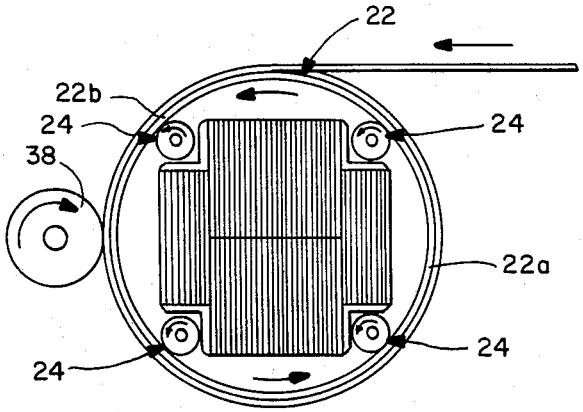
FIG. 4 is a cross-sectional view of the arrangement illustrated in FIG. 3, taken generally along line 4—4 in FIG. 3.
Figure 5:
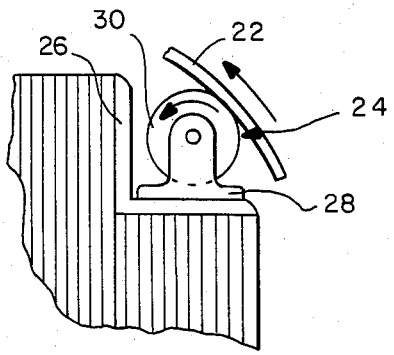
FIG. 5 is an enlarged end view of a portion of the arrangement illustrated in FIGS. 3 and 4 illustrating a specific aspect of the arrangement.

Referring to FIGS. 3–5, attention is now directed to an arrangement generally indicated at 20 for assembling an electrical coil around one of the straight sections of core 10, for example section 14. This arrangement includes a straight tubular member 22 which is preferably constructed of a card stock paper or other such relatively rigid dielectric material. As best illustrated in FIG. 4, this tube is disposed concentrically around core section 14 in relatively close fitting relationship therewith and is supported in this position for rotation about its axis and the axis of the core section by suitable means. The core cross-section illustrated in FIG. 4 is that shown in FIG. 2*b* and hence includes diametric corners 18. These corners are utilized to receive four support roller assemblies 24 which serve to support the tubular member 22 for rotation about its own axis.

One of the roller assemblies 24 is illustrated in FIG. 5 and is shown there including an angled flange 26 which conforms to and is suitably fixedly bonded into an associated one of the inside corners 18. One side of this flange supports an upstanding pair of parallel brackets 28, only one of which is illustrated in FIG. 5. The two brackets together support a roller 30 for rotation about its own axis. With each of these assemblies fixedly held in place within its associated inside corner 18 in the manner shown in FIG. 4, the four rollers together engage the inside surface of the tubular member so as to allow the latter to freely rotate about its own axis relative to core section 14.

Figure 6:
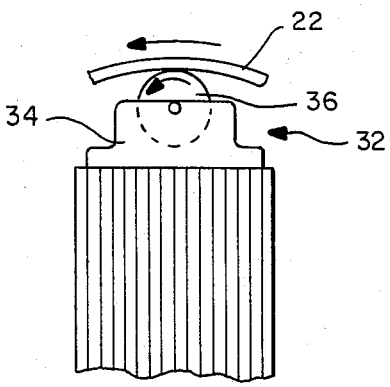
FIG. 6 is a view similar to FIG. 5 but illustrating a modified aspect of the arrangement illustrated in FIGS. 3 and 4.

In the event that core 10 does not include a cross-sectional configuration containing inside corners 18 such as the one illustrated in FIG. 2*a*, different roller assemblies could be readily utilized. For example, a bearing assembly of the type generally indicated at 32 in FIG. 6 could be fixedly mounted to each side of section 14 of the type illustrated in FIG. 2*a*. As seen in FIG. 6, each bearing assembly includes a bearing housing 34 and associated bearing 36 which engages the inside surface of tubular member 22 in the same manner as rollers 30.

In the case where core 10 is of closed loop shape as illustrated in FIG. 1, it should be obvious that the tubular member 22 must be initially provided in longitudinal sections or in some other way which will allow it to be initially assembled around its associated core section. In the particular embodiment illustrated, the tubular member is comprised of two axial half sections 22*a* and 22*b* which are bonded or otherwise fixedly assembled together around core section 14. It should be apparent that the segmented tubular member is unnecessary if the transformer core is not in the shape of a closed loop but rather designed so that the tubular member can be disposed around its associated core section in one piece. While overall arrangement 20 can be utilized in conjunction with a magnetic core of this type, it is most suitable for use with a core having a closed loop shape and therefore, in these cases, the tubular member would have to be segmented or otherwise designed to be readily disposed around its core section. One nonsegmented way to accomplish this is to initially provide the tubular member as a continuous strip which is itself wrapped around the core section and formed into a tubular member in that way.

Returning to FIGS. 3 and 4, overall arrangement 20 is shown also including a pair of rollers 38 which are disposed adjacent to and urged against tubular member 22 by suitable means so as to cause the tubular member to rotate when the roller are caused to rotate. A drive motor 40 is coupled to the rollers 38, as indicated by dotted lines at 42, for rotating the rollers and, in turn, causing the tubular member to rotate. At the same time, a supply of coil material generally indicated at 44 is provided in a condition ready to be wound into a coil. In the particular embodiment illustrated in FIGS. 3 and 4, the coil material is in the form of a continuous strip approximately equal in width to the length of tubular member 22. This strip of material may be initially provided around its own spool (not shown). In any event, in order to ultimately provide a coil of this material around core section 14, an end section 46 of coil material 44 is initially wrapped around or otherwise attached to the outer surface of tubular member 22 in a way which causes the strip to be wound around the tubular member as the latter is caused to rotate about its own axis, as best indicated by the various arrows in FIG. 4. As seen in this latter figure and in FIG. 3, the two press rolls are positioned so as to ultimately engage against the coil itself as the latter is formed. In this case, the means for supporting the rollers would have to do so in a way which allows the latter to be forced outwardly as the coil being formed increases in thickness. This is not necessary in the case where the strip material is not as wide as the tubular member and the rollers bear only against circumferential segments of the tubular member not including the ultimately formed coil.

Figure 7:
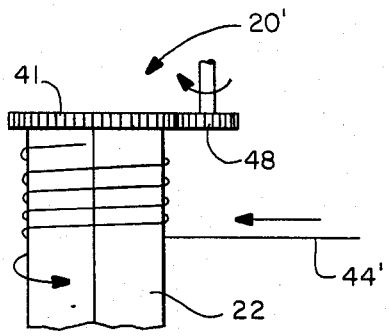
FIG. 7 is a side elevational view of a portion of an arrangement designed in accordance with a second embodiment of the present invention for assembling an electrical coil around one leg of the magnetic core illustrated in FIG. 1.

While overall arrangement 20 has been described in conjunction with the formation of an electrical coil formed from continuous, relatively wide strip material, it is to be understood that the same arrangement could be utilized to form a coil from continuous lengths of wire. Moreover, overall arrangement 20 could be readily provided with suitable means other than rollers 38 for rotating the tubular member 22. For example, FIG. 7 discloses an arrangement 20' including tubular member 22 and two cooperating gears 41 and 48. The gear 41 is fixedly connected in a concentric fashion to one end of tubular member 22 and the gear 48 is disposed in meshed engagement therewith. The gear 48 is driven by means of a power mechanism such as the previously recited motor 40 (not shown) for rotating gear 46 and thereby rotating the tubular member 22. In the arrangement 20', a wire coil 44' is shown being wound around the tubular member rather than the strip 44 described with respect to arrangement 20. Obviously, arrangement 20' could be utilized in conjunction with strip 44 while arrangement 20 could be utilized in conjunction with wire coil 44'.

FIG. 8 illustrates still another arrangement 20'' including a tubular member 22 and two belt or chain supporting spools, sprockets or the like generally indicated at 50 and 52. The spool or sprocket 50 is fixedly connected in a concentric fashion to one end of tubular member 22 and the spool or sprocket 52 is spaced therefrom. The two cooperate with one another to support a belt, chain or the like generally indicated by dotted lines shown in FIG. 8 such that rotation of the spool or sprocket 52 causes the spool or sprocket 50 to rotate and therefore tubular member 22. In this way, the wire 44' (or strip 44) can be wound around the tubular member in the manner shown. The spool or sprocket may be rotated by any suitable power mechanism such as the previously described drive motor 40.

Having described arrangement 20 and modified arrangements 20' and 20'', attention is now directed to yet another arrangement for assembling an electrical coil around one section of a transformer core, for example section 14 illustrated in FIG. 1. This latter arrangement is generally indicated by the reference numeral 56 in FIG. 9 and includes the same tubular member 22 forming part of the previously described arrangements. In addition, arrangement 56 includes a pair of circular end plates 58 larger in diameter than the tubular member 22 fixedly connected concentrically to opposite ends of the tubular member, as seen in FIG. 9. These two end plates include in their confronting surfaces annular grooves 59 which are concentrically located with respect to the axis of tubular member 22 and which are larger in diameter than the tubular member. Arrangement 56 also includes a cylindrical carrier 60 for coil material, for example wire 44'. The carrier itself is shorter in length than tubular member 22 and includes rotation pins fixedly connected to and extending outwardly from its opposite ends in coaxial relationship therewith. These pins are disposed within the two grooves 59 for rotation.

The coil wire 44' is initially wound around the cylindrical carrier and one end segment thereof is initially would around or otherwise attached to the outer surface of tubular member 22. In this way, it is possible to rotate the entire tubular member around the axis of the cylindrical carrier or the cylindrical carrier could be rotated entirely around the axis of the tubular member in order to ultimately wind the wire around the tubular member for providing the electrical coil. However, in a preferred embodiment, the cylindrical carrier 60 is preferably prevented from moving from its position shown in FIG. 9, that is, its position in parallel relationship with and in close proximity to tubular member 22, while being allowed to rotate about its own axis. In this way, the tubular member 22 can be caused to rotate about its own axis and about core section 14 by suitable means after the wire 44' is initially wound around or attached thereto. By rotating the tubular member in the direction shown by arrow 64, the wire 44 is caused to unwind from carrier 60 and wind onto the tubular member which, in turn, causes the carrier to rotate about its axis as indicated by the arrow 66. In order to prevent the carrier from rotating with the tubular member in the direction of arrow 64, a relatively rigid bar 68 or like means fixedly connected to a stationary surface 70 at one end and engaging one of the rotation pins 62 at its other end may be provided. The tubular member itself may be rotated by any suitable means such as a press roller 72 placed in suitable engagement with the brim of one of the end plates 58. Roll 72 may be driven by any suitable power means such as a motor 40.

What is claimed is:

1. A method of assembling a coil around a straight section of a core in the manufacture of a transformer, said method comprising the steps of:

(a) placing a coil supporting straight tubular member around said core section in a way which allows said member to rotate about its own axis and around the core section, said tubular member being provided with circular end plates diametrically larger than said tubular member and fixedly attached concentrically to the ends of said tubular members;

(b) providing annular grooves on the confronting sides of said end plates concentrically around said tubular member;

(c) providing a supply of coil material such that the material is ready to be wound into a coil;

(d) supporting said supply of coil material in a wound fashion around a separate tubular carrier shorter in length than said tubular member;

(e) supporting said carrier for rotation about its own axis adjacent to and in parallel relationship with said tubular member by means extending outward from the opposite ends of said carrier and into said grooves;

(f) connecting one end of said coil material to said tubular member;

(g) causing said tubular member to rotate by means of a power driven mechanism; and (h) preventing said carrier from moving other than rotating about its axis, whereby rotation of said tubular member about its own axis causes said coil material to unwind from its carrier and onto the tubular member.

2. The method according to claim 1 wherein said step of causing said tubular member to rotate includes the steps of providing at least one roller means and rotating said roller means while urging the latter in pressed engagement against said tubular member, either directly or indirectly, so as to rotate said member.

3. A method according to claim 1 wherein said supply of coil material is in the form of wire.

4. A method according to claim 1 wherein said step of winding said coil material around said tubular member so as to form a coil around the latter includes the steps of initially attaching one end of said coil material as initially supplied to a predetermined point on the outer surface of said tubular member before the latter is rotated, whereby the subsequent rotation of said tubular member will automatically cause said coil material to be wound around it so as to form said coil.

* * * * *